US005223855A

United States Patent [19]

Ota et al.

[11] Patent Number: 5,223,855

[45] Date of Patent: Jun. 29, 1993

[54] THERMAL HEAD FOR A PRINTER

[75] Inventors: Shigenori Ota, Aira; Tsuyoshi Yasutomi, Kokubu; Kenji Nakai; Masayuki Nomoto, both of Aira, all of Japan

[73] Assignee: Kyocera Corporation, Kyoto, Japan

[21] Appl. No.: 486,438

[22] Filed: Feb. 28, 1990

[30] Foreign Application Priority Data

Mar. 1, 1989 [JP] Japan ..... 1-50902

[51] Int. Cl.[5] ..... B41J 2/34

[52] U.S. Cl. ..... 346/76 PH

[58] Field of Search ..... 346/76 PH, 139 C, 139 R; 219/538, 539, 540, 541, 542, 543

[56] References Cited

U.S. PATENT DOCUMENTS 4,680,593 7/1987 Takeno et al. ..... 346/76 PH
5,028,935 7/1991 Warmack et al. ..... 346/76 PH

FOREIGN PATENT DOCUMENTS 135138 3/1976 Japan .
487748 6/1979 Japan .
0048375 3/1985 Japan .
144892 3/1986 Japan .
0140844 9/1986 Japan .
62-37737 9/1987 Japan .
0221055 9/1988 Japan .
0078859 3/1989 Japan .
0078860 3/1989 Japan .
1-290454 11/1989 Japan .
1-175828 12/1989 Japan .
2-212157 8/1990 Japan .

*Primary Examiner*—Benjamin R. Fuller
*Assistant Examiner*—Huan Tran
*Attorney, Agent, or Firm*—Spensley Horn Jubas & Lubitz

[57] ABSTRACT

The invention provide a thermal head wherein a head substrate composed by disposing plural heating resistance elements on a support board, and a flexible wiring substrate for connecting the heating resistance elements and an external circuit are adhered together by using a soft adhesive with the shear adhesion strength of 25 kg/cm$^2$ or less.

According to the invention, without having to dispose a reinforcing plate for reinforcing the flexible wiring substrate, the flexible wiring substrate and the head substrate are adhered directly with soft adhesive, and therefore when printing, especially when printing continuously, if the temperature of the head substrate and flexible wiring substrate is raised, the difference in the thermal expansion of the two is absorbed sufficiently by the elasticity of the elastic wiring substrate, and the difference in the thermal expansion between the head substrate and flexible wiring substrate and support board is absorbed by the soft adhesive, and hence the deformation of the thermal head may be eliminated completely, and the transmission of electric signal from external circuit to the integrated circuit is made accurate, so that printing may be done in normal state.

20 Claims, 6 Drawing Sheets

THERMAL HEAD FOR A PRINTER

BACKGROUND OF THE INVENTION

1. Field of the Invention

The present invention relates to a thermal head of a thermal printer used as the printer for word processor or typewriter, or in the facsimile receiver.

2. Description of the Prior Art

A typical prior art is shown in FIG. 1. A thermal head 200 is basically composed of a head substrate 202 and a head cover 203 covering this head substrate 202. The head substrate 202 possesses a row of multiple resistance heating elements 204 forming heating dots on a substrate 212, and an external terminal 205 for giving electric signals for selectively heating the resistance heating elements 204. On the external terminal 205 of the head substrate 202, a terminal 207*a* formed on a wiring conductor 207 of a wiring substrate 206 is overlaid, and the both are mounted on a support board 208. The head substrate 202 and wiring board 206 are held and pressed by the head cover 203 and support board 208. A thermal recording paper 209 is fed in a direction vertical to the row of arrangement of the resistance heating elements 204 (the direction of arrow A). When this recording paper 209 is supplied, the heating resistance elements 204 are selectively energized and heated, and dots are formed on the recording paper 209 pressed by a platen 210 so as to be printed.

The resistance heating elements 204 are divided into groups in each plurality, and electrodes 211 connected to the resistance heating elements 204 are connected to an integrated circuit device 214 of each group disposed on the substrate 212. To the integrated circuit device 214, an electric signal is applied from an external electric circuit through the external terminal 205 formed on the substrate 212. This integrated circuit device 214 is covered with silicone rubber 215 excellent in water resistance and chemical resistance in order to protect the integrated circuit device 214 and its connection part. The leading end of this wiring conductor 207 is the terminal 207*a*.

The wiring substrate 206 has the wiring conductor 207 printed and formed on the surface opposite the head substrate 202 of the film 216 made of synthetic resin having an electric insulating performance. The external terminal 205 and terminal 207*a* are joined together, and are pressed by a pressing member 217 fixed to the head cover 203. The pressing member 217 is made of a synthetic resin possessing an elasticity, and is stretched over the whole length of the region in which terminals 205, 207*a* are disposed.

In the head cover 203, an insertion hole 218 is formed, and another insertion hole 219 is formed in the wiring substrate 206. In these insertion holes 218, 219, a bolt 220 penetrates loosely. A screw hole 221 is machined in a support board 208, and the bolt 220 is driven into this screw hole 221. Accordingly, the terminal 207*a* of the wiring substrate 206 and the terminal 204 of the head substrate 202 are overlaid on the support board 208, and when the head cover 203 is fixed to the support board 208 by the bolt 220, the both terminals 205, 207*a* are pressed and connected by the head cover 203 and support board 208.

When printing, in particular when printing continuously, if the temperature of the head substrate 202 and support board 208 is raised, the head substrate 202 may be warped due to difference in the coefficient of thermal expansion of them. In other words, since the coefficient of thermal expansion of the aluminum-made support board 208 is larger than the coefficient of thermal expansion of the ceramic-made substrate 212, when these temperatures are raised, the boards are curved within the plane extending in the arrangement direction of the resistance heating elements 204 (the direction vertical to the sheet of paper in FIG. 1), which is schematically shown in FIG. 2.

When such thermal head 200 is used in the facsimile equipment and the head substrate 202 is curved as in the above case, if the maximum displacement d1 due to warping of the head substrate 202 becomes more than 0.1 mm, the resistance heating elements 204 may partly fail to contact with the thermal recording paper 209, and the thermal transmission from the resistance heating elements 204 is worsened, so that printing may be unclear.

SUMMARY OF THE INVENTION

It is hence a primary object of the invention to solve the above problems, and present a thermal head capable of always printing normally, by enabling to transmit electric signals correctly from the external circuit to the integrated circuit.

It is other object of the invention to present a thermal head, by solving the above problems, capable of realizing printing action in normal state, without warping the head substrate, even in the raised state of the temperature of the head substrate and support board when printing, in particular, when printing continuously.

It is another object of the invention to present a thermal head, by solving the above problems, capable of reinforcing the connection state of terminals of the head substrate and wiring substrate in a simple structure, while reducing the size of the structure.

To achieve the above objects, the invention provides a thermal head wherein the head substrate composed by disposing plural heating resistance elements on a support board, and the flexible wiring substrate for connecting the heating resistance elements and an external circuit are adhered together by using a soft adhesive with the shear adhesion strength of 25 kg/cm$^2$ or less.

In a preferred embodiment, the 90-degree peeling strength of the adhesive is preferably 200 g or more per 25 mm of length.

In a different preferred embodiment, the thickness of the soft adhesive is 10 to 200 $\mu$m.

In a further preferred embodiment, the adhesive is an acrylic adhesive.

The invention also presents a thermal head wherein the head substrate composed by arranging plural heating resistance elements is attached onto a support board by means of a soft adhesive.

In a preferred embodiment, the shear adhesion strength of the soft adhesive is 25 kg/cm$^2$ or less.

In other preferred embodiment, nearly the middle of the head substrate in the lengthwise direction is fixed with a hard adhesive.

The invention still more presents a thermal head comprising a head substrate mounting a heating resistance element row and an integrated circuit device for selectively driving the heating resistance row on a support board, a wiring substrate possessing wiring conductors for connecting the heating resistance elements and integrated circuit device to an external circuit, and a head cover, wherein the integrated circuit device is covered with a hard protective member, and a guide portion of a thermal recording paper is formed by the protective member and the leading end part of the head cover.

In a preferred embodiment, the protective member possesses a Shore hardness of 60 or more.

In a further preferred embodiment, the terminals coming out from the heating resistance elements and integrated circuit device on the head substrate, and the terminals of wiring conductors on the wiring substrate are connected by soldering.

In a different preferred embodiment, a protrusion is formed on the head cover, and this protrusion is fixed in the mounting hole formed in the support board in a state of elastically thrusting the head cover to the support board side.

In a further different preferred embodiment, near the mounting hole of the support board, a stepwise thin mounting portion is formed on the opposite side of the head substrate, and the leading end of the protrusion is prevented from projecting from the remaining surface at the opposite side of the head substrate of the support board.

In another preferred embodiment, the head cover is made of polypropylene synthetic resin.

In still another preferred embodiment, the surface roughness of the protective member is 60 μm or less.

In a further different preferred embodiment, the thickness of the head cover portion covering the connection portion by soldering of the head substrate and wiring substrate is 3 mm or less.

According to the invention, without having to dispose a reinforcing plate for reinforcing the flexible wiring substrate, the flexible wiring substrate and the head substrate are adhered directly with soft adhesive, and therefore when printing, especially when printing continuously, if the temperature of the head substrate and flexible wiring substrate is raised, the difference in the thermal expansion of the two is absorbed sufficiently by the elasticity of the elastic wiring substrate, and the difference in the thermal expansion between the head substrate and flexible wiring substrate and support board is absorbed by the soft adhesive, and hence the deformation of the thermal head may be eliminated completely, and the transmission of electric signal from external circuit to the integrated circuit is made accurate, so that printing may be done in normal state.

Thus, according to one aspect of the invention, if the temperature of the head substrate, wiring substrate and support board is raised when printing, especially when printing continuously, to cause difference in the thermal expansion, it is absorbed by the soft adhesive and the head substrate will not deform. Or if the temperature of the head substrate and wiring substrate is elevated to cause difference in thermal expansion between the two, since the wiring substrate is flexible, the difference is absorbed, and hence the connection of the external terminal of the conductor disposed on the head substrate and the terminal of the wiring substrate may be secure. Therefore, even in continuous printing, printing may be continued in normal state, and deterioration of printing quality may be prevented.

In the invention, the support board and the head substrate are adhered with a soft adhesive. Therefore even in the state of elevated temperature of the head substrate and support board when printing, especially when printing continuously, the head substrate will not be warped due to the difference in the coefficient of thermal expansion of them. For example, if the thermal expansion of the support board is greater than that of the head substrate, the difference in the thermal expansion between the two is absorbed by the soft adhesive, and warping of the head substrate is prevented. That is, displacements of head substrate and support board in thermal expansion may be allowed. Therefore, if the temperature is raised in, for example, continuous printing, the head substrate will not be warped, so that printing may be continued in normal state.

Conforming to the invention, moreover, even in the state of elevated temperature of the head substrate and support board when printing, especially when printing continuously, the difference in the thermal expansion between the two is absorbed by the soft adhesive, and therefore the head substrate will not be warped. Hence, even in continuous printing, printing may be continued in normal state, and deterioration of printing quality may be prevented.

Still more, in the invention, since the integrated circuit device is covered with a hard protective member, the integrated circuit device and its connection position may be protected only by this protective member, so that it is not necessary to put ahead cover on the protective member. Therefore, the head cover may be reduced in size. Besides, since it is not needed to cover the protective member with the leading end of the head cover, a guide part of the thermal recording paper may be formed by the leading end portion of the head cover and the protective member, and the structure of the apparatus may be simplified, and be reduced in size.

The integrated circuit device is, in the invention, covered with a hard protective member. Accordingly, only by this protective member, the integrated circuit device and its connection portion can be protected, and it is not necessary to put a protective cover on the protective member. Therefore, the head cover may be reduced in size. Moreover, it is not necessary to cover the protective member with the leading end portion of the head cover, a guide part for the thermal recording paper may be formed by the leading end of the head cover and the protective member, and therefore the structure of the apparatus may be simplified, and reduced in size.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
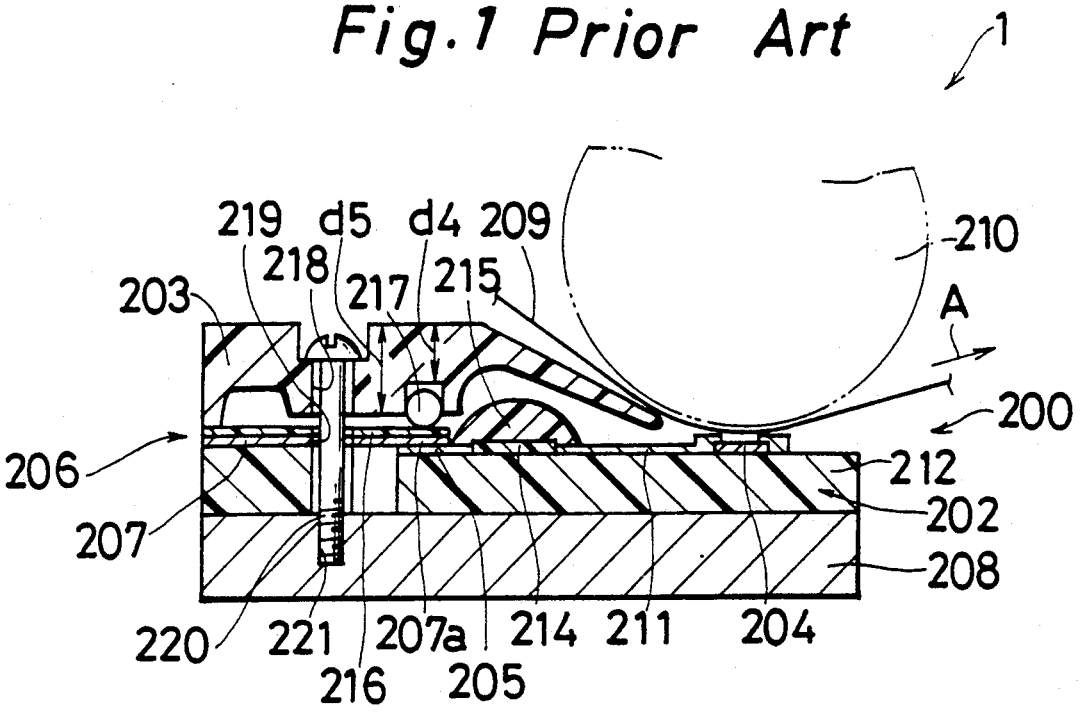
Fig. 1 Prior Art
FIG. 1 is a longitudinal sectional view of a typical prior art.
Figure 2:
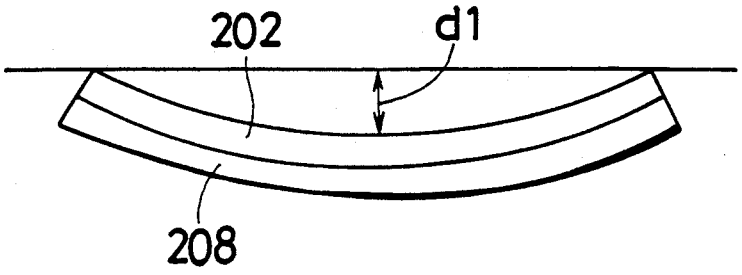
Fig. 2 Prior Art
FIG. 2 is a drawing for showing the problems of the prior art shown in FIG. 1.

Now referring to the drawing, preferred embodiments of the invention are described below.

Figure 3:
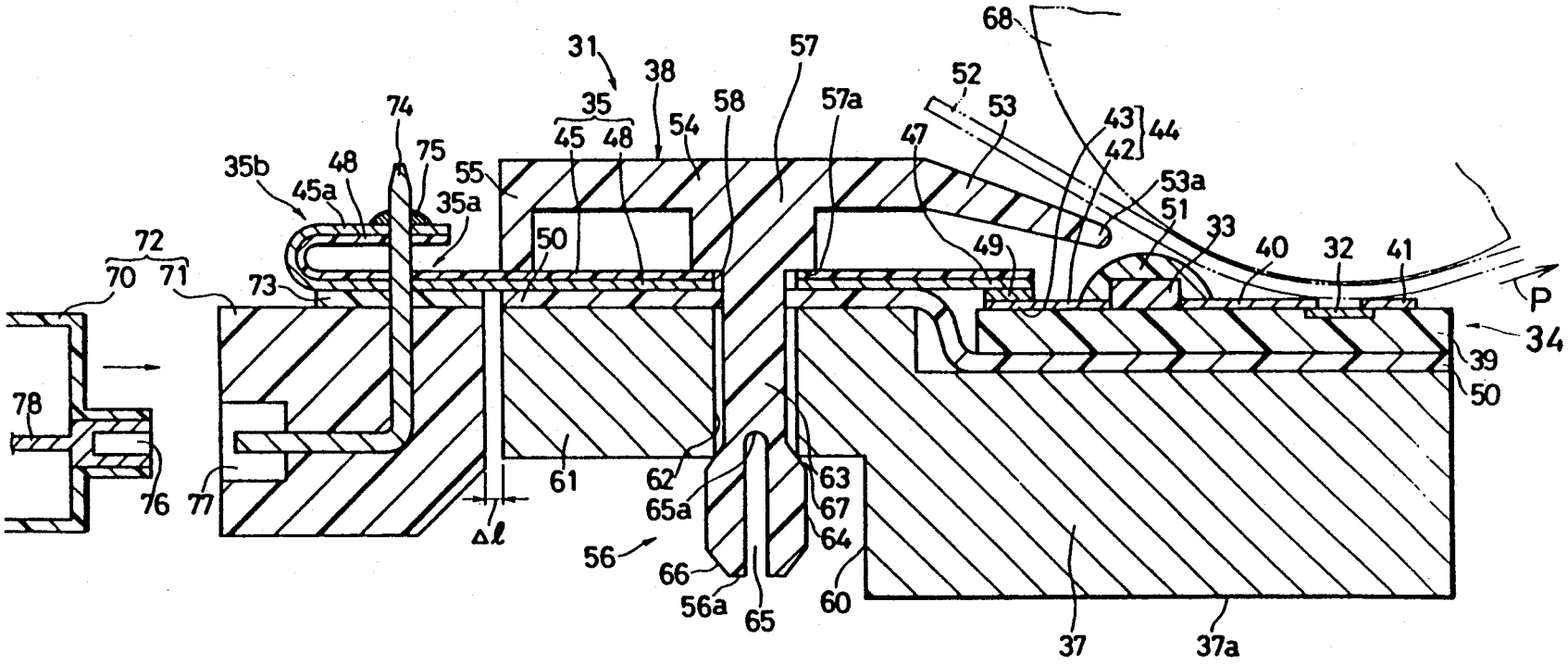
FIG. 3 is a longitudinal sectional view showing the structure of a thermal head 31 as one of the embodiments of the invention.
Figure 4:
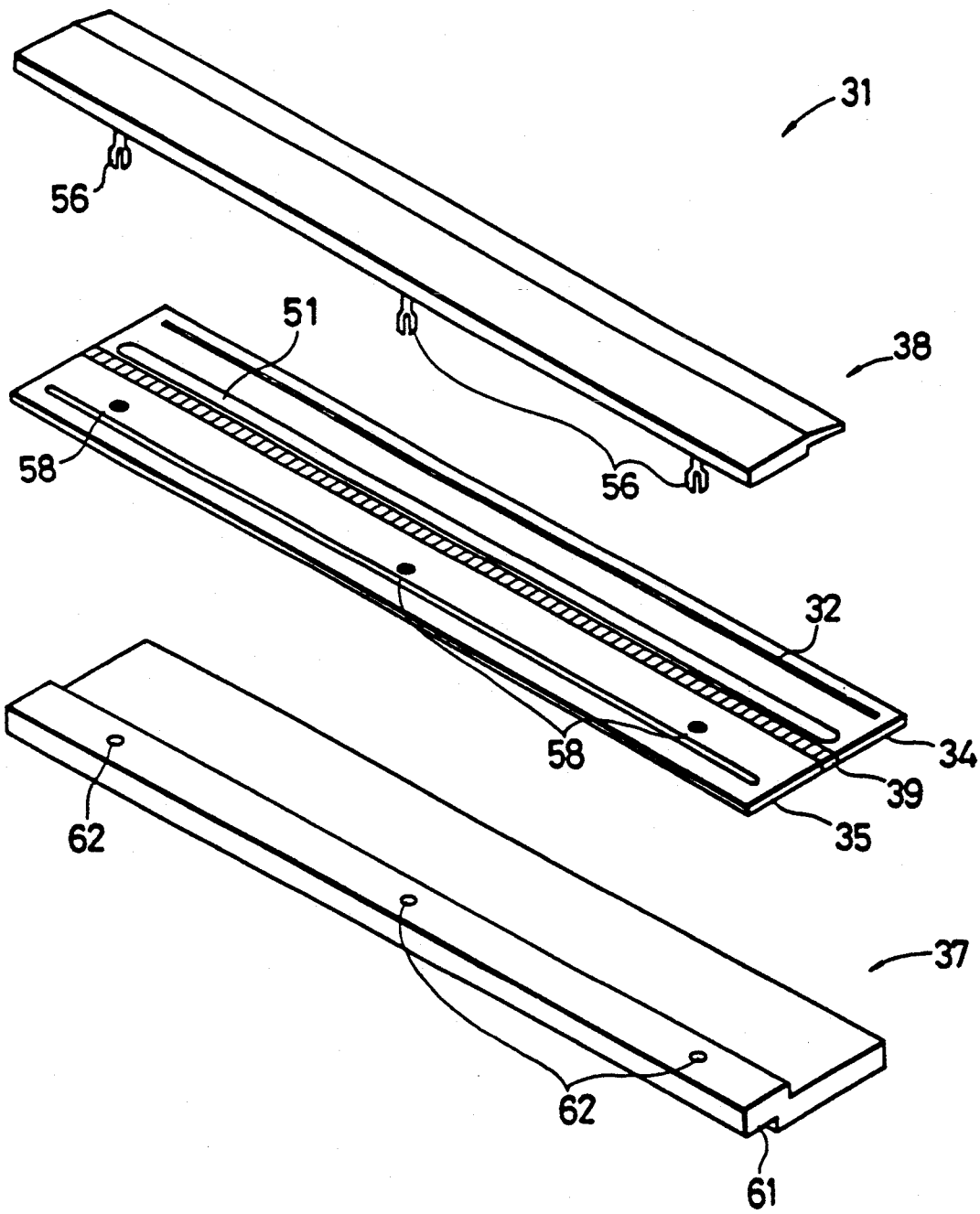
FIG. 4 is a perspective exploded view of the thermal head 31.

FIG. 3 is a longitudinal sectional view showing the structure of a thermal head in an embodiment of the invention, and FIG. 4 is a perspective exploded view of the thermal head 31. The thermal head 31 comprises a head substrate 34 possessing a heating resistance element 32 and an integrated circuit device 33, a wiring substrate 35, a support board 37 for supporting the head substrate 34, and a head cover 38 for covering them all.

In the construction of the head substrate 34, the heating resistance element 32 is formed on a flat substrate 39 made of an electrically insulating material such as alumina ceramic, by vapor deposition as thin film technique, or by screen printing as thick film technique. On the heating resistance element 32, conductors 40, 41 are formed as electrodes, and an electric power for inducing Joule heat in the heating resistance element 32 is applied to the conductors 40, 41.

The heating resistance element 32 is divided into groups of a plurality, and the conductor 40 connected to each heating resistance element 32 is connected to the integrated circuit device 33 of each group disposed on the substrate 39. This integrated circuit device 33 is provided with an electric signal from an external electric circuit through a conductor 44 formed on the substrate 39. The conductor 44 is composed by comprising a conductor portion 42 and an external terminal 43, and the integrated circuit device 33 is intended to apply an electrical force for selectively heating the heating resistance element 32 to the heating resistance element 32 through the conductor 40 by an electric signal from the external terminal 43.

The wiring substrate 35 comprises a substrate 45 made of, for example, an elastic synthetic resin material possessing electric insulation, and plural wiring conductors 48 formed to correspond individually to the external terminal 43 of the head substrate 34 on the surface poosite to the head substrate 34 of the substrate (the bottom surface of FIG. 3). The overall thickness is selected at, for example, 0.3 mm. The wiring conductor 48 comprises a terminal 47 individually connected to the external terminal 43. This terminal 47 is connected to the external terminal 43 individually by solder 49, and deviation of connected state by impact from outside is prevented thereby.

The head substrate 34 and wiring substrate 35 are connected to the support board 37 with a soft adhesive 50 which is described below. This support board 37 is made of, for example, aluminum, and functions as a cooling plate for releasing part of the heat by the heating resistance element 32, thereby preventing the head substrate 34 from becoming high temperature abnormally.

To the wiring substrate 35, an electric signal is applied through a connector 72 composed of connector end members 70, 71. That is, the wiring substrate 35 is composed of an extension portion 35*a* extending outward from the portion connected through the soft adhesive 50 on a mounting part (the portion for mounting a head cover 38 stated below) 61 of the support board 37, and a bent portion 35*b* extending further outward from the extension portion 35*a* and bending. The extension portion 35*a* is connected to the connector end member 71 through an adhesive 73. The connector end member 71 is fixed with a connection piece 74 for transmitting the electric signal from the connector end member 70 to the wiring substrate 35. This connection piece 74 penetrates through the extension portion 35*a* and bent portion 35*b* of the wiring substrate 35 and adhesive 73, and is electrically connected to the wiring conductor portion 45*a* of the bent portion 35*b* through solder 75.

By connecting the connection end portion 76 of the connector end member 70 to the connection end member 77 of the connector end member 71, a conductor 78 of the connector end member 70 and the wiring conductor 48 of the wiring substrate 35 may be electrically connected. The interval 1 of the mounting portion 61 of the connector end member 71 and support 37 is selected under 1.5 mm, and when mounting the connector end member 70 to the connector end portion 71, breakage due to undesired deformation of the wiring substrate 35 is prevented.

The integrated circuit device 33 is coated with a protective member 51 made of a hard material with the Shore hardness of, for example, 60 or more, and it is protected from the impact from outside by this protective member 51. If the Shore hardness is less than 60, it is too soft, and the integrated circuit device 33 and its connection positions cannot be sufficiently protected from external force. The surface roughness of the protective member 51 is, for example, 60 μm or less and it is formed smoothly, and accordingly as stated below the thermal recording paper 52 can slide smoothly on the protective member 51, so that wear of the protective member 51 may be inhibited. When the surface roughness is over 60 μm, the surface of the protective member 51 frictionally contacts with the thermal recording paper 52 to make the thermal recording paper 52 fluffy, and wear of the protective member 51 is accelerated.

The head cover 38 is made of, for example, polypropylene synthetic resin material, and possesses a guide portion 53 for guiding the thermal recording paper 52, a peak portion 54, and a support piece 55 for supporting the head cover 38. On the bottom surface (the lower side in FIG. 3) of the peak portion 54 of the head cover 38, two or three right columnar protrusions 56 are set up at equal intervals on the mounting base part 57 in the longitudinal direction (the vertical direction of the sheet of paper of FIG. 3).

In the wiring substrate 35, penetration holes 58 are formed correspondingly to the positions where protrusions 56 are made. A notch 60 is formed at the left side of FIG. 3 in the support board 37, and in the stepwise thin mounting part 61 formed by this notch 60, mounting holes 62 for mounting the protrusions 56 are formed. The upper end portion of the mounting portion 61 is projecting to the head cover 38 side correspondingly to the head substrate 34 and thickness, so that the wiring substrate 35 may be held in flat state.

The protrusions 56 are composed of right cylindrical shaft part 63 and head part 64, and a notch 65 opening toward the free end is formed in the head part 64, extending in the axial direction of the shaft part 63. At the free end of the head part 64, a guide slope surface 66 is formed, and a support slope surface 67 is formed near the shaft part 63. Meanwhile, the bottom 65*a* of the notch 65 is extending to the base end side of the shaft part 63, rather than the support slope surface 67.

Thus composed protrusions 56 are set in the mounting holes 62 of the mounting part 61, penetrating through the penetration holes 58 formed in the wiring substrate 35. When the protrusions 56 penetrate into the penetration holes 58 and mounting holes 62, they are guided and inserted into the guide slope surface 66 of the head part 64 while the free end of the notch 65 of the head part 64 is slightly closed. In the state of fitting of protrusions 56, the lower end of the mounting holes 62 is abutting against the support slope surface 67 of the head part 64, and an elastic force toward the lower side acts on the protrusions 56 by the opening force of the notch 65 in this state. As a result, the end face 57*a* of the mounting base part 57 presses the wiring substrate 35 to the downward side, and the wiring substrate 35 and support board 37 are held by the end face 57*a* and the head 64 of the protrusions 56.

The notch 60 of the support board 37 is formed so that the free end surface 56*a* of the protrusions 56 may be flush with the end face 37*a* of the support board 37 or inward in the thicknesswise direction of the support board 37, that is, not be projecting, when the head part 64 of the protrusions 56 is mounted on the support board 37.

The guide part 53 of the head cover 38 is positioned at the upstream side (the left side in FIG. 3) in the conveying direction of the thermal recording paper 52 from the axial line of the integrated circuit device 33 at its front end part 53*a*, and makes up the guide portion for guiding the thermal recording paper 52 together with the protective member 51 for covering the integrated circuit device 33. The front end 53*a* of the guide part 53 is formed in an arc form having a roundness of about 0.3 to 0.4 mm within the section vertical to the shaft. This is intended not to injure the thermal recording paper 52 is guided by the guide part 53. The protective member 51 for protecting the integrated circuit device 33 has a smooth surface with the surface roughness of 60 μm or more as stated above, and when the thermal recording paper 52 conveyed from the guide part 53 contacts with the protective member 51, fluffy forming of the front end part of the thermal recording paper 52 is prevented.

The thermal recording paper 52 guided by the protective member 51 is pressed to the heating resistance element 32 by a rubber platen 68 and conveyed in the direction of arrow P.

Since a hard material is used for the protective member 51 for protecting the integrated circuit device 33, the integrated circuit device 33 can be protected only by this protective member 51, and hence it is not necessary to cover the protective member 51 with the head cover 38. Therefore, the guide part 53 of the head cover 38 may be shortened, and the guide block of the thermal recording paper 52 may be composed together with the protective member 51, so that the guide part 53 of the head cover 38 may be reduced in size.

Besides, when mounting the head cover 38 on the support board 37, it is designed to mount by using the protrusions 56, and hence mounting is very easy. Furthermore, the terminal 47 of the wiring substrate 35 and the terminal 43 of the conductor 44 are connected with solder 49, it is not necessary to apply external force separately in order to hold the connection state of them, and therefore the thickness of the corresponding portion of the head cover 38 may be considerably reduced, and accordingly the thickness of the related portion, that is, the head cover 38 between the connecting position of the both terminals 43, 47 and the forming portions of the protrusions 56 may be considerably reduced. For example, the thickness of the head cover guide portion 53 covering the connection portion by solder 49 between the head substrate 34 and wiring substrate 35 may be set to 3 mm or less. Consequently, the structure of the thermal head 31 may be reduced in size.

The head substrate 34, wiring substrate 35, and support board 37 are adhered with soft adhesive 50 as stated above. The reason of using the soft adhesive is to absorb the difference in the coefficient of thermal expansion of the head substrate 34, wiring substrate 35 and support board 37 by this soft adhesive 50. Therefore, if the head substrate 34 and wiring substrate 35 are heated to high temperature during printing to cause a difference in thermal expansion from the support board 37, this difference is absorbed by deforming the soft adhesive 50, so that the thermal head will not be deformed. Meanwhile, the head substrate 34 may be adhered to the support board 37 with the soft adhesive 50, and also fixed near the middle position in the longitudinal direction of the head substrate 34 with a hard adhesive (lump) for a short distance. This is intended to prevent fluctuation of the position of the head substrate 34 to the support board 37 due to thermal expansion.

The wiring substrate 35 is small in thickness and is flexible, and if the temperature of the head substrate 34 and the wiring substrate 35 is raised to cause difference in thermal difference between the two, the difference is absorbed by the deformation of the wiring substrate 35, and peeling will not occur between the terminal 47 of the wiring substrate 35 and the external terminal 43 of the conductor 44 disposed on the head substrate 34.

Figure 5:
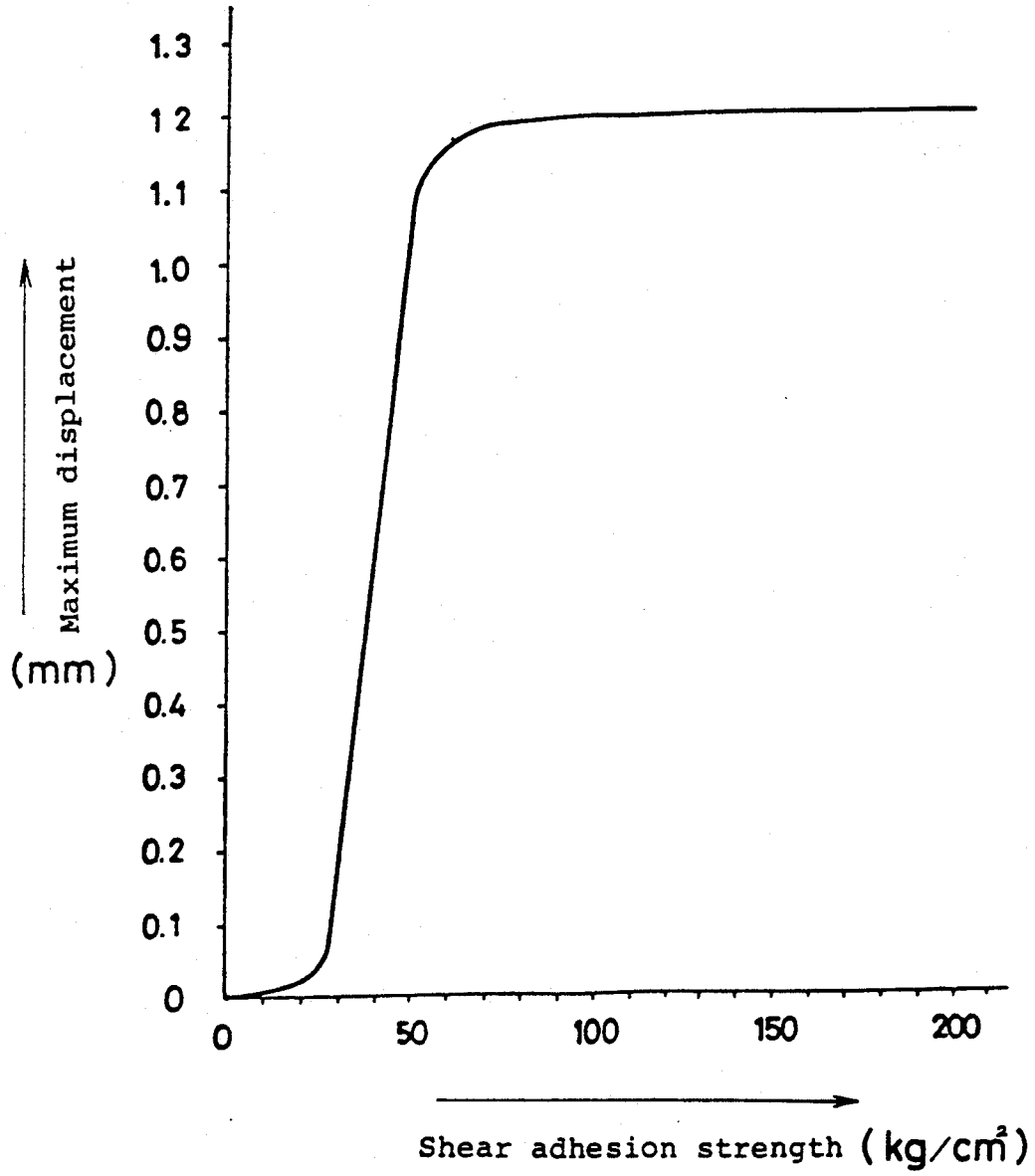
FIG. 5 is a graph showing the experimental results by the present inventor.

FIG. 5 is a graph showing the result of experiment conducted in order to obtain an optimum shear adhesion strength of the soft adhesive 50. Hereinafter the experimental technique of the present inventor and its results are described.

Figure 6:
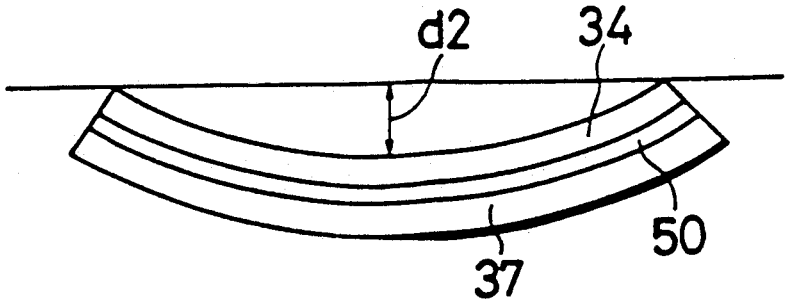
FIG. 6 to FIG. 8 are drawings for explaining the experimental technique of the present inventor.

The head substrate 34 comprising the heating resistance element 32 may be heated nearly to 80 degrees when printed continuously. At this time, the heat of the head substrate 34 is transmitted to the support board 37 functioning the role of cooling plate through the adhesive 50. In such a case, due to the difference in the coefficient of thermal expansion between the substrate 39 made of alumina ceramic material and the support board 37 made of aluminum, the head substrate 34 and support board 37 are curved as shown in FIG. 6. The maximum displacement d2 caused by such curving is considered to vary depending on the shear adhesion strength of the adhesive for adhering the head substrate 34 and support board 37.

Figure 7:
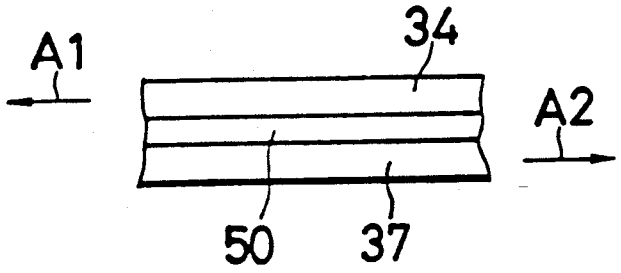

Accordingly, the present inventor investigated the shear adhesion strengths of various adhesives (that is, the value of the force to separate the head substrate 34 and support board 37 when a force is applied in the direction of arrows A1, A2, shown in FIG. 7 to the head substrate 34 and support board 37), and measured the maximum displacement d2 in the curved state by using adhesives having various shear adhesion strengths.

The support board 37 as the cooling plate measured 19 mm in width, 240 mm in length, and 5 mm in thickness, and the substrate 39 made of alumina ceramic measured 18.8 mm in width, 232 mm in length, and 0.65 mm in thickness. In this experiment, by heating the head substrate 34 at ordinary temperature of 25° C. to a maximum estimated temperature of 80° C., that is, to a difference of 55° C. from the ordinary temperature, the maximum displacement d2 in the curved state was measured. The results are shown in the graph in FIG. 5.

Referring to FIG. 5, when the adhesive of which shear adhesion strength is 25 kg/cm$^2$ or less is used, the maximum displacement d2 is 0.1 mm or less, and when the shear adhesion strength exceeds 25 kg/cm$^2$, the maximum displacement d2 elevates suddenly, and when the adhesive with the shear adhesion strength of 50 kg/cm$^2$ or more is used, the maximum displacement d2 becomes nearly 1.2 mm, and at the higher shear adhesion strength, the maximum displacement d2 remains nearly at 1.2 mm. On the other hand, the allowable range of the maximum displacement d2 for executing normal printing action by using the head substrate 34 in curved state is said to be 0.1 mm. Therefore, as evident from the graph in FIG. 5, it is desired that the shear adhesion strength of the adhesive used as the soft adhesion 50 be 25 kg/cm$^2$ or less.

Figure 8:
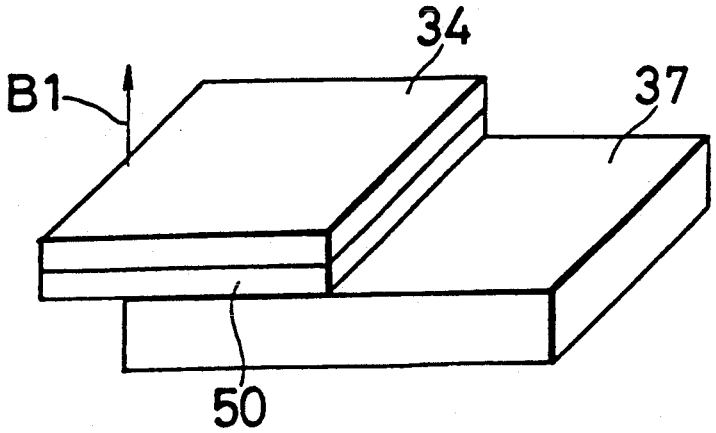

The present inventor also experimented as follows. That is, as shown in FIG. 8, the strength of peeling the head substrate 34 from the support board 37 in the direction vertical to the surface of adhesion (the direction of arrow B1 in FIG. 8), that is, the so-called 90-degree peeling strength was measured by using various adhesives. As a result, it was found desired to use adhesives having the strength of 200g or more per 25 mm of length. That is, if the strength is less than 200g per 25 mm of length, the adhesion strength of the head substrate and support board 37 is not sufficiently large, and the durability of the thermal head 31 deteriorates.

Besides, the thickness of the soft adhesive 50 should be preferably 10 to 200 μm. If the thickness of the adhesive 50 is less than 10 μm, the adhesion strength of head substrate 34 and support abord 37 is not enough. Or if the thickness exceeds 200 μm, the heat of the heated head substrate 32 cannot be sufficiently transmitted to the support board 37, and the head substrate 34 is overheated, and the printing quality deteriorates. That is, if the head substrate 34 is not cooled properly, the region other than the desired region of the heating resistance element 32 is heated, and desired printing action is not executed, and the printing quality deteriorates. Because of this reason, it is desired that the thickness of the adhesive 50 be about 10 to 200 μm. As the material of this adhesive 50, for example, an acrylic adhesive may be used.

Thus, in this embodiment, the head substrate 34, wiring substrate 35 and support board 37 are adhered by using the properties as described herein, and therefore when printing, especially when printing continuously, if the temperature of the head substrate 34, wiring substrate 35 and support board 37 is raised to cause difference in the thermal efficient, the difference in thermal expansion may be fully absorbed by the soft adhesive 50, and the maximum displacement d2 due to curving may be restricted below a desired level. Or, without using the intervening reinforcing plate as mentioned in the prior art, the wiring substrate 35 and support board 37 are directly adhered, and therefore peeling of the solder 49 due to difference in the coefficient of thermal expansion between the reinforcing plate and substrate 39 may be prevented, and printing may be done continuously without deterioration of the printing quality.

Figure 9:
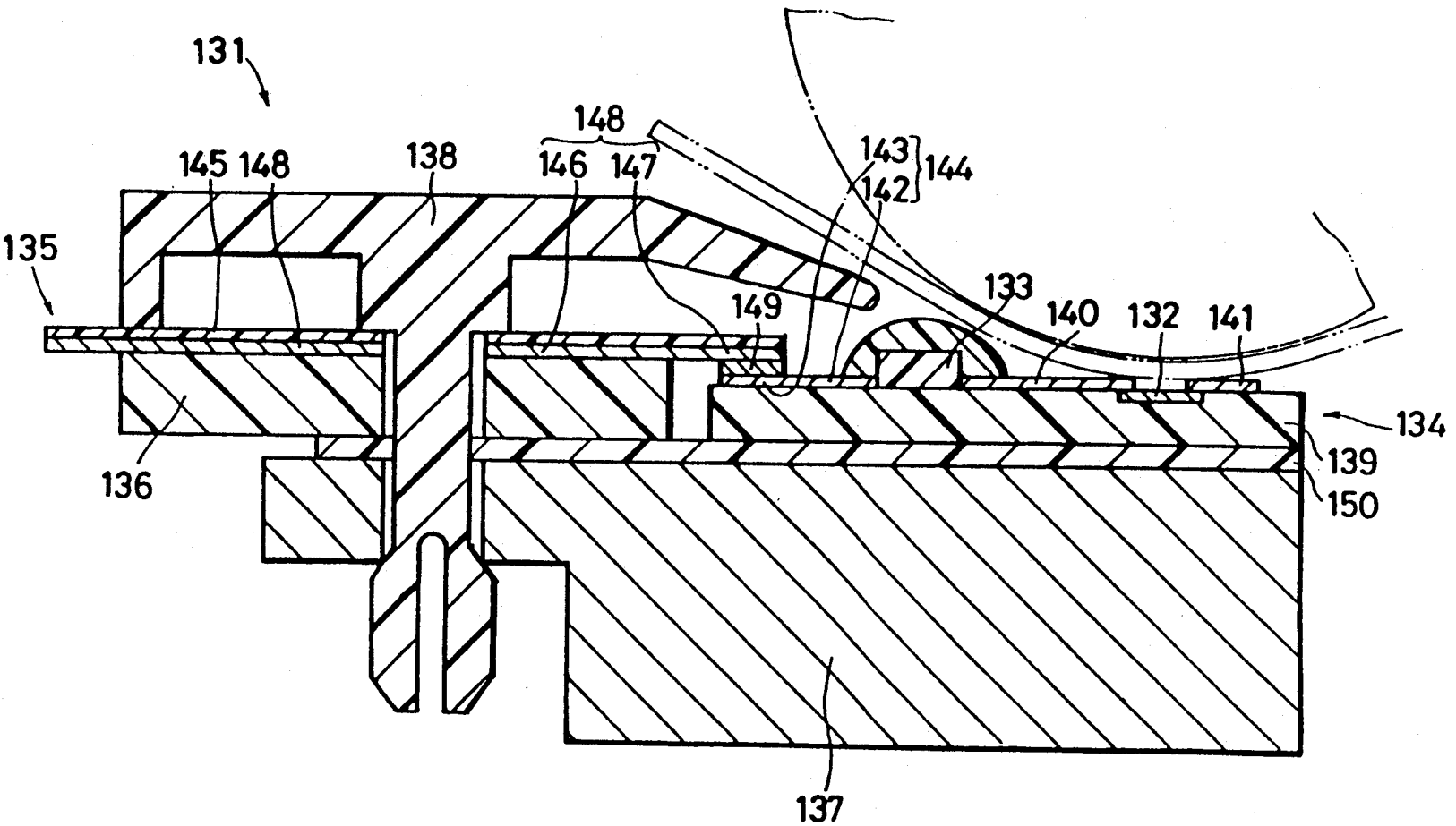
FIG. 9 is a sectional view of other embodiment.

FIG. 9 is a sectional view of other embodiment of the invention. This embodiment is similar to the foregoing embodiment, and the corresponding parts are indicated by adding numeral 1 in the hundred's digit. A thermal head 131 comprises a head substrate 134 having a heating resistance element 132 and an integrated circuit device 133 disposed on a substrate 139, a flexible wiring substrate 135, a reinforcing plate 136 for reinforcing the wiring substrate 135, a support board 137 for supporting the head substrate 134, and a head cover 138 for covering them all.

On the substrate 139, conductors 140, 141 are formed as electrodes, and a voltage for generating Joule heat is applied to the conductors 140, 141 through the heating resistance element 132. The integrated circuit 133 is connected to the conductor 140. An electric signal is applied to the integrated circuit 133 from an external circuit through a conductor 144 formed on the substrate 139. The conductor 144 comprises a conductor portion 142 and an external terminal 143.

The wiring substrate 135 comprises a substrate made of an elastic synthetic resin material, and plural wiring conductors 148 formed individually corresponding to the external terminal 143 on the surface of the substrate 145. The wiring conductors 148 comprise conductor portions 146 and terminal 147 individually connected to the external terminals 143.

The terminal 147 is connected to the external terminal 143 individually with solder 149. The substrate 139 and reinforcing plate 136 on which the heating resistance element 132 of the conductor is formed is adhered to the support board 137 with soft adhesive 150.

When printing, especially when printing continuously, in the temperature elevated state of the head substrate 134, the difference in the thermal expansion between the head substrate 134 and support board 137 is absorbed by the soft adhesive 150.

In the embodiment in FIG. 9, meanwhile, the difference in the thermal expansion between the reinforcing plate 136 and head substrate 134 is not absorbed, but the reinforcing plate 136 is proportional to the head substrate 134, and is extended largely in the arranging direction (the direction vertical to the sheet of paper in FIG. 1) of the heating resistance element 132.

That is, as the material for the reinforcing plate 136, paper phenol (the coefficient of thermal expansion $2.2\times10^{-5}$/° C.) or glass epoxy (the coefficient of thermal expansion 1.3 to $1.5\times10^{-5}$/° C.) is selected, and as the material for the substrate 139 of the head substrate 134, $Al_2O_3$ with the coefficient of thermal expansion of 0.7 to $0.8\times10^{-5}$/° C. is selected, for example. Therefore, when the temperature of the head substrate 134 and reinforcing plate 136 is raised when printing, since the coefficient of thermal expansion of the reinforcing plate 136 is large, the reinforcing plate 136 is largely extended in the longitudinal direction (the direction vertical to the sheet of paper in FIG. 7) as compared with the head substrate 134. Thus, when the reinforcing plate 136 is extended more than the head substrate 134, the solder 149 realizing the electric connection of the terminal 147 of wiring substrate 135 and external terminal 143 of conductor 144 is peeled off, and electric signal from external circuit may not be transmitted to the integrated circuit 133, which results in lowering of printing quality. The embodiment described in FIG. 1 to FIG. 8 solves this problem.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

a support board;

a head substrate disposed over the support board; the head substrate having disposed thereon a plurality of heating resistance elements and an integrated circuit device for driving the heating resistance elements;

a flexible wiring substrate disposed over the support electrically coupled to the heating resistance elements;

a soft adhesive layer bonding the flexible wiring substrate to the support board, the soft adhesive layer having a shear adhesion strength of 25 $Kg/cm^2$ or less, a head cover disposed over the support board, said head cover having a leading end part; and a hard protective member covering the integrated circuit device, wherein the hard protective member and the leading end part of the head cover are positioned in alignment to guide a thermal recording paper.

2. A thermal head as recited in claim 1, wherein the soft adhesive layer has a 90-degree peeling strength of preferably 200 g or more per 25 mm of length.

3. A thermal head as recited in claim 1, wherein thickness of the soft adhesive is 10 to 200 $\mu m$.

4. A thermal head as recited in claim 1, wherein the adhesive is an acrylic adhesive.

5. A thermal head comprising:

a support board;

a head substrate disposed over the support board; the head substrate having a plurality of heating resistance elements disposed thereon, wherein the head substrate is fixed to the support board near a middle position in a lengthwise direction of the head substrate with a hard adhesive; and a soft adhesive layer disposed between the support board and the head substrate for bonding the support board to the head substrate.

6. A thermal head comprising:

a support board;

a head substrate disposed over the support board; said head substrate having disposed thereon a row of heating resistance elements and an integrated circuit device for selectively driving the heating resistance elements;

a soft adhesive layer for elastically bonding the support board to the head substrate;

a wiring substrate including wiring conductors electrically coupled to the heating resistance elements and the integrated circuit device;

a head cover disposed over the support board, said head cover having a leading end part; and a hard protective member covering the integrated circuit device, wherein the hard protective member and the leading end part of the head cover are positioned in alignment to guide a thermal recording paper to be printed.

7. A thermal head comprising:

a support board;

a head substrate disposed over the support board; said head substrate having disposed thereon a row of heating resistance elements and an integrated circuit device for selectively driving the heating resistance elements;

a wiring substrate including wiring conductors electrically coupled to the heating resistance elements and the integrated circuit device;

a head cover disposed over the support board, said head cover having a leading end part; and a hard protective member covering the integrated circuit device, wherein the hard protective member and the leading end part of the head cover are positioned in alignment to guide a thermal recording paper to be printed, wherein the protective member possesses a Shore hardness of 60 or more.

8. A thermal head comprising:

a support board;

a head substrate disposed over the support board; said head substrate having disposed thereon a row of heating resistance elements and an integrated circuit device for selectively driving the heating resistance elements;

a wiring substrate including wiring conductors electrically coupled to the heating resistance elements and the integrated circuit device;

a head cover disposed over the support board, said head cover having a leading end part;

a hard protective member covering the integrated circuit device, wherein the hard protective member and the leading end part of the head cover are positioned in alignment to guide a thermal recording paper to be printed;

a first terminal coupled to the integrated circuit device on the head substrate; and a second terminal coupled to the wiring conductors on the wiring substrate wherein the first terminal and the second terminal are connected by soldering.

9. A thermal head as recited in claim 8, wherein a portion of the head cover covering the solder connection between the first terminal and the second terminal has a thickness of 3 mm or less.

10. A thermal head comprising:

a support board defining therein a mounting hole;

a head substrate disposed over the support board; said head substrate having disposed thereon a row of heating resistance elements and an integrated circuit device for selectively driving the heating resistance elements;

a wiring substrate including wiring conductors electrically coupled to the heating resistance elements and the integrated circuit device;

a head cover disposed over the support board, said head cover having a leading end part and including a protrusion wherein the protrusion cooperatively engages with the mounting hole of the support board for elastically thrusting the head cover toward the support board; and a hard protective member covering the integrated circuit device, wherein the hard protective member and the leading end part of the head cover are positioned in alignment to guide a thermal recording paper to be printed.

11. A thermal head as recited in claim 10, wherein the support board includes a stepwise thin mounting portion formed on an opposite side of the head substrate, wherein the mounting hole is provided in the stepwise thin mounting portion and the protrusion has a leading end which terminates before a bottom surface of the support board when the projection is mounted in the mounting hole.

12. A thermal head comprising:

a support board;

a head substrate disposed over the support board; said head substrate having disposed thereon a row of heating resistance elements and an integrated circuit device for selectively driving the heating resistance elements;

a wiring substrate including wiring conductors electrically coupled to the heating resistance elements and the integrated circuit device;

a head cover of polypropylene synthetic resin disposed over the support board, said head cover having a leading end part; and a hard protective member covering the integrated circuit device, wherein the hard protective member and the leading end part of the head cover are positioned in alignment to guide a thermal recording paper to be printed.

13. A thermal head comprising:

a support board;

a head substrate disposed over the support board; said head substrate having disposed thereon a row of heating resistance elements and an integrated circuit device for selectively driving the heating resistance elements;

a wiring substrate including wiring conductors electrically coupled to the heating resistance elements and the integrated circuit device;

a head cover disposed over the support board, said head cover having a leading end part; and a hard protective member covering the integrated circuit device, wherein the hard protective member and the leading end part of the head cover are positioned in alignment to guide a thermal recording paper to be printed, and wherein a surface roughness of the protective member is 60 $\mu$m or less.

14. A thermal head comprising:

a support board;

a head substrate disposed over the support board; the head substrate having a plurality of heating resistance elements and an integrated circuit device coupled to the heating resistance elements for selectively driving the heating resistance elements;

a wiring substrate including a wiring conductor electrically coupled to the integrated circuit device;

a head cover disposed over the support board, said head cover having a leading end part;

a hard protective member covering the integrated circuit device; wherein the hard protective member and the leading end part of the head cover are positioned in alignment to guide a thermal recording paper to be printed; and a soft adhesive layer disposed on the support board for elastically bonding the support board and the head substrate, the soft adhesive layer having a thickness sufficient to absorb a difference in the thermal expansion between the head substrate and the support board thereby preventing the head substrate from being warped.

15. A thermal head comprising:

a support board;

a head substrate disposed over the support board; the head substrate comprising a plurality of heating resistance elements and an integrated circuit device coupled to the heating resistance elements for selectively driving the heating resistance elements;

a wiring substrate including a wiring conductor electrically coupled to the integrated circuit device;

a head cover disposed over the support board, said head cover having a leading end part;

a hard protective member covering the integrated circuit device; wherein the hard protective member and the leading end part of the head cover together define guide means for guiding a thermal recording paper to be printed; and a soft adhesive layer disposed on the support board for bonding the support board and the head substrate, the soft adhesive layer having a thickness sufficient to absorb a difference in the thermal expansion between the head substrate and the support board thereby preventing the head substrate from being warped wherein the soft adhesive layer has a shear adhesion strength of 25 $Kg/cm^2$ or less.

16. A thermal head comprising:

a support board;

a head substrate disposed over the support board; the head substrate comprising a plurality of heating resistance elements and an integrated circuit device coupled to the heating resistance elements for selectively driving the heating resistance elements;

a soft adhesive layer disposed on the support board for bonding the support board and the head substrate, the soft adhesive layer having a thickness sufficient to absorb a difference in the thermal expansion between the head substrate and the support board thereby preventing the head substrate from being warped;

a wiring substrate including a wiring conductor electrically coupled to the integrated circuit device, wherein the wiring substrate is disposed on the soft adhesive layer;

a head cover disposed over the support board, said head cover having a leading end part; and a hard protective member covering the integrated circuit device; wherein the hard protective member and the leading end part of the head cover together define guide means for guiding a thermal recording paper to be printed.

17. A thermal head comprising:

a support board;

a head substrate disposed over the support board; the head substrate comprising a plurality of heating resistance elements and an integrated circuit device coupled to the heating resistance elements for selectively driving the heating resistance elements;

a wiring substrate including a wiring conductor electrically coupled to the integrated circuit device;

a head cover disposed over the support board, said head cover having a leading end part;

a hard protective member covering the integrated circuit device; wherein the hard protective member and the leading end part of the head cover together define guide means for guiding a thermal recording paper to be printed;

a soft adhesive layer disposed on the support board for bonding the support board and the head substrate, the soft adhesive layer having a thickness sufficient to absorb a difference in the thermal expansion between the head substrate and the support board thereby preventing the head substrate from being warped; and a reinforcing plate provided between the wiring substrate and the soft adhesive layer disposed on the support board.

18. A thermal head for printing on thermal paper fed in a predetermined direction to the thermal head, said thermal head comprising:

a support board;

a head substrate disposed over the support board;

a plurality of heating resistance elements disposed on the head substrate;

an integrated circuit device disposed on the head substrate for driving the heating resistance elements;

a flexible wiring substrate electrically coupled to the heating resistance elements;

a head cover disposed over the support board, said head cover having a leading end part; and a hard protective member covering the integrated circuit device, wherein the hard protective member and the leading end part of the head cover are positioned in alignment in the direction of feed of the thermal paper to guide the thermal paper to the heating resistance elements.

19. A thermal head comprising:

a support board which defines therein a mounting hole;

a head substrate disposed over the support board;

a plurality of heating resistance elements disposed on the head substrate; and a head cover disposed over the support board, said head cover including an elastic protrusion received in the mounting hole of the support board and engaging the support board to elastically pull the head cover toward the support board.

20. A thermal head comprising:

a support board;

a head substrate disposed over the support board, said head substrate defining a lengthwise direction;

a plurality of heating resistance elements disposed on the head substrate;

a soft adhesive layer disposed between the support board and the head substrate for bonding the support board to the head substrate; and a hard adhesive for bonding the head substrate to the support board in proximity to a center of the head substrate along the lengthwise direction thereof, said hard adhesive bonding the head substrate more firmly to the support board than the soft adhesive.

* * * * *